US007184655B2

(12) United States Patent
Dehli

(10) Patent No.: US 7,184,655 B2
(45) Date of Patent: Feb. 27, 2007

(54) FOOTREST WITH INTEGRAL HEATER

(75) Inventor: Hans Dehli, Dana Point, CA (US)

(73) Assignee: Interactive Health, LLC., Long Beach, CA (US)

( * ) Notice: Subject to any disclaimer, the term of this patent is extended or adjusted under 35 U.S.C. 154(b) by 0 days.

(21) Appl. No.: 11/178,206

(22) Filed: Jul. 7, 2005

(65) Prior Publication Data

US 2006/0027551 A1 Feb. 9, 2006

Related U.S. Application Data

(60) Provisional application No. 60/586,135, filed on Jul. 7, 2004.

(51) Int. Cl.
*A47J 27/00* (2006.01)

(52) U.S. Cl. ..... 392/380; 34/90

(58) Field of Classification Search ..... None
See application file for complete search history.

(56) References Cited

U.S. PATENT DOCUMENTS 4,873,966 A * 10/1989 Gitter ..... 601/63
5,356,203 A * 10/1994 Levasseur et al. ..... 297/423.45
6,003,242 A * 12/1999 Carley et al. ..... 34/202
6,189,231 B1 * 2/2001 Lancer ..... 34/90
2002/0189125 A1 * 12/2002 Lancer ..... 34/90

* cited by examiner

*Primary Examiner*—Thor S. Campbell
(74) *Attorney, Agent, or Firm*—Christie, Parker & Hale, LLP.

(57) ABSTRACT

A footrest is provided comprising a base portion for placement on a supporting surface, a footplate connected to the base portion for receiving a foot of a user of the footrest, a heater connected to the base portion, an air intake system connected to the heater for drawing a first mass of air into the footrest, and an exhaust connected to the heater for expelling a second mass of air from the footrest. The heater receives the first mass of air, heats it, and expels it as a second mass of air. A warm air shield helps redirect the second mass of air expelled through the exhaust at the foot of the user placed on the footplate. The footplate may be made to pivot with respect to the base portion, or may be provided with a control knob so that a user may control the heater using her foot.

18 Claims, 4 Drawing Sheets

FOOTREST WITH INTEGRAL HEATER

CROSS-REFERENCE TO RELATED APPLICATION

This application claims the benefit of U.S. Provisional Application No. 60/586,135, filed Jul. 7, 2004, the contents of which are incorporated fully herein.

FIELD OF THE INVENTION

The present invention is related generally to adjustable footrests, more particularly, to a footrest having an integral two-stage heater for directing streams of heated air onto the feet of a user.

SUMMARY OF THE INVENTION

The present invention provides a footrest for supporting and heating a user's foot. The footrest includes a footplate for receiving a user's foot, and a warm air delivery system. The warm air delivery system uses a fan to draw ambient air from the environment into the a housing of the footrest through a cold air intake. The fan then propels the ambient air down a heating channel in which resides a heating element. After traversing and being warmed by the heating element, the now warm air continues down the heating channel and exits the housing of the footrest at a warm air exhaust. The footrest is provided with a warm air shield for redirecting the heated air expelled from the warm air exhaust onto a user's foot.

In preferred embodiment of the present footrest, the fan provided for drawing ambient air into the housing of the footrest is a quiet radial fan. In another preferred embodiment, the heating element is a two stage heater comprising a coil of nichrome wire wrapped around insulating mica boards.

A high/low heat switch is provided for varying the amount of heat generated by the heating element, and thus the temperature of the air directed at a user's feet. This high/low heat switch may be mounted on the footplate so that a user of the footrest can control the setting of the switch using her foot. Additionally, the footplate can be made to pivot along an axis to provide a desired angle for a user of the footrest.

Safety devices may be provided as part of a wiring harness of the present footrest, such as a ground fault interrupt device and a safety cut-off switch, to prevent accidental burns or shocks to a user of the footrest.

Figure 1:
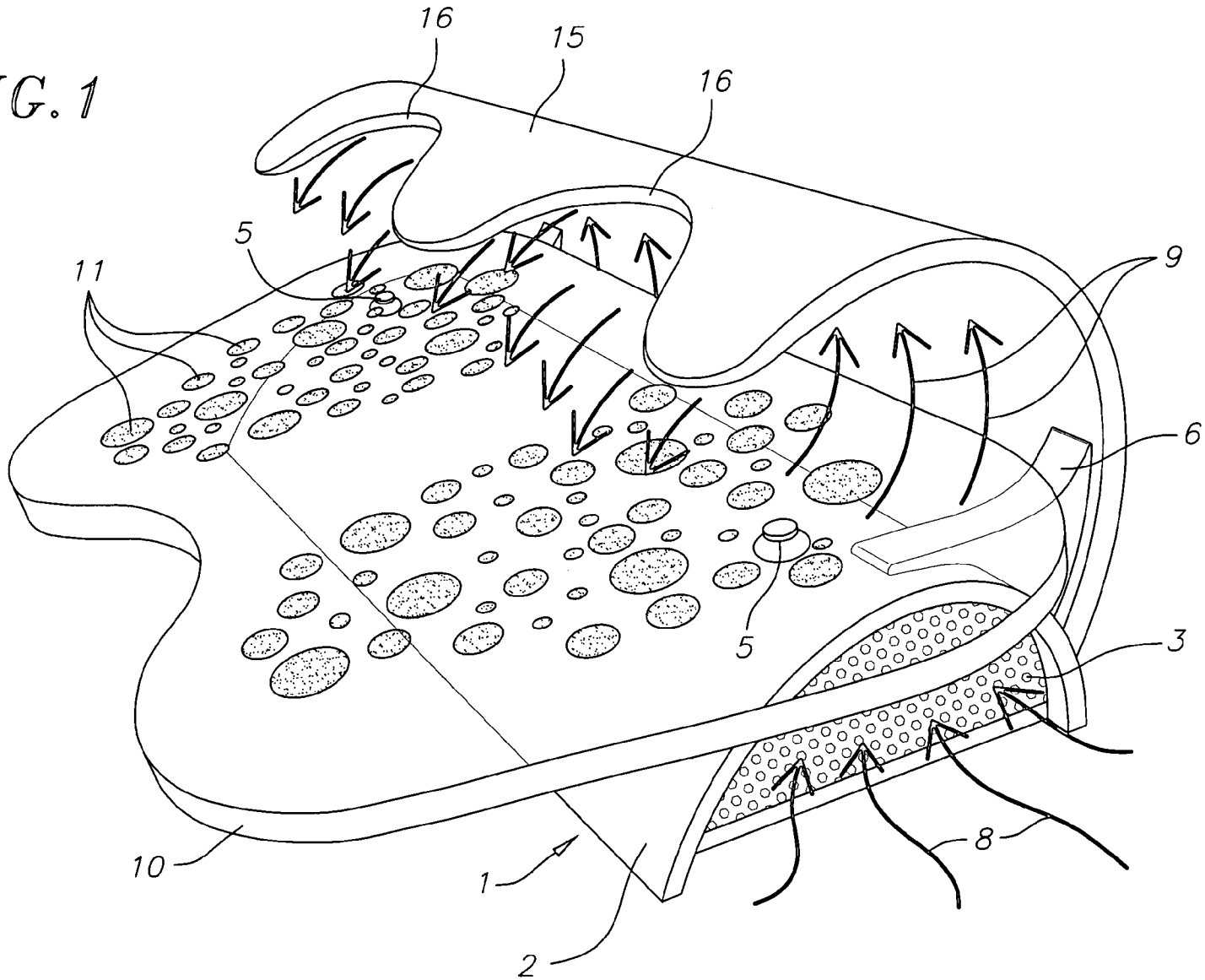
FIG. 1 is an oblique perspective of an exemplary embodiment of the footrest with integral heater of the present invention.

Before any embodiment of the invention is explained in detail it is to be understood that the invention is not limited in its application to the exemplary details of construction and arrangements of components set forth in the following description or illustrated in the drawings. The invention is capable of alternative embodiments and of being practiced or being carried out in various ways. Also, it is to be understood that the terminology used herein is for the purpose of illustrative description and should not be regarded as limiting.

DETAILED DESCRIPTION OF THE INVENTION

Now referring to the figures, FIG. 1 shows an oblique view of an exemplary embodiment of the footrest with integral heater of the present invention. The footrest includes a base 1 having a cold air intake 3, a base housing 2 and the components contained therein (shown in more detail in the following figures) for receiving a mass of cold air through the cold air intake 3 and heating and expelling a mass of warm air. Vectors 8 indicate the mass of cold air being drawn into the cold air intake 3, shown in the foreground of FIG. 1. Once the mass of cold air is drawn into the base 1 of the footrest and heated to a desired temperature, it is expelled as a mass of warm air from a warm air exhaust on the rear of the base 1 (not visible in FIG. 1). Vectors 9 indicate the origin and direction of travel the mass of warm air.

A footplate 10 is provided attached to the base 1 of the footrest using one or more mounting devices 5, as shown in FIG. 1. The footplate 10 is provided to support one or both feet of a user, and may be provided with multiple friction elements 11 allowing the footplate 10 to better grip the user's feet. The footplate 10 may be provided with the general shape of an outline of a pair of human feet.

The footplate 10 may also be provided with an adjusting mechanism allowing it to pivot around an axis formed by the mounting devices 5 shown in FIG. 1. In one embodiment, the adjusting mechanism comprises a flexible washer around each mounting device 5. The footplate 10 may be only loosely connected to the base 1 using the mounting devices 10. When the angle of the footplate 10 is depressed slightly, for example by the weight of a user's foot, the elastic properties exhibited by the flexible washers in compression exert a reaction force on the footplate 10 balancing the downward force of the user's foot. This is but one embodiment; other provisions for an adjusting mechanism for the footplate 10 will be known to those skilled in the art.

One or more mounting brackets 6 are provided attached to the base 1 of the footrest. The mounting brackets 6 are used to attach a warm air shield 15 to the base 1. The warm air shield is provided to allow for the redirection of the mass of warm air onto the feet of a user of the footrest. The vectors 9 show the mass of warm air being redirected along the interior concave surface of the warm air shield 15, from an initially vertical direction when the vectors 9 exit the base 1 of the footrest to a partially downward direction towards the footplate 10. In this manner, a user who places her feet on the footplate 10 may have them warmed by the redirected mass of warm air represented by the vectors 9.

It should be understood that the design of the warm air shield 15 shown in FIG. 1 is exemplary only and that a variety of interior surfaces may be provided for the warm air shield 15 in order to produce varying orientations of the vectors 9 indicating a mass of warm air directed over the feet of a user of the footrest.

The warm air shield 15 may additionally incorporate a series of recesses 16 as shown in FIG. 1 for aesthetic and/or functional purposes. In the embodiment shown, the recesses 16 are placed so as to allow a greater clearance between the warm air shield 15 and the footplate 10, allowing a user of the footrest to more easily place her foot on the footplate 10 without the instep of the foot coming into contact with the warm air shied 15.

Figure 2:
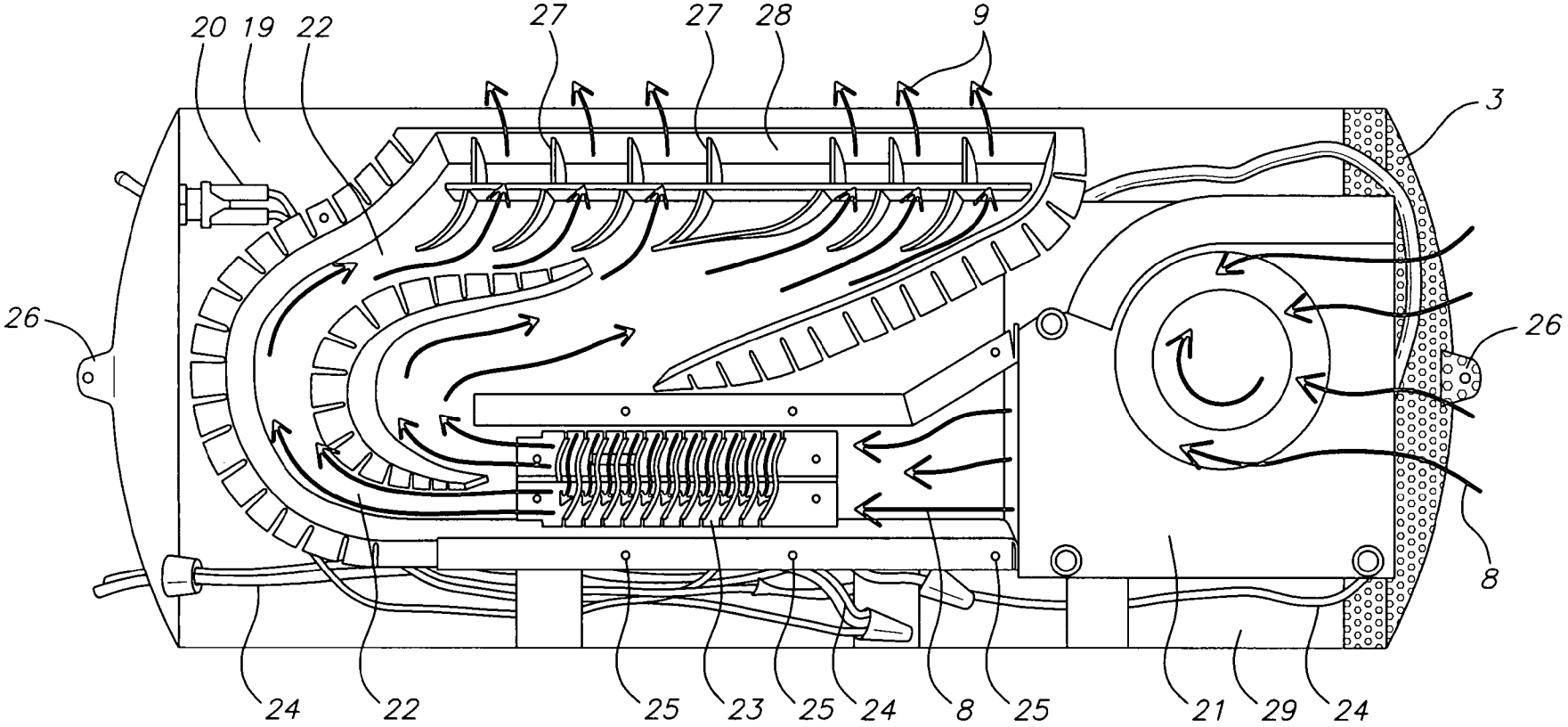
FIG. 2 is an overhead view of the exposed interior of the base of the footrest shown in FIG. 1.

FIG. 2 depicts an interior view of the base 1 of the previous figure. The base 1 includes a base plate 29, having mounting brackets 26 for facilitating the attachment of the base housing 2 shown in the previous figure to the base plate 29 of the base 1.

Mounted on the base plate 29 is a radial fan 21 adjacent to a heating element 23, which is itself adjacent to a heating channel 22. Ambient air is drawn into the base 1 from the environment through the cold air intake 3 by the radial fan 21. The airflow generated by the radial fan 21 is forced through the heating channel 22, in which resides the heating element 23, shown to the left of the radial fan 21 in FIG. 2. Vectors 8 indicate a mass of cold air being drawn into the radial fan 21 and expelled across the heating element 23 in the heating channel 22. As the mass of cold air traverses the heating element 23, it warms and continues to travel down the heating channel 22.

The heating channel 22 terminates at a warm air exhaust 28. The warm air exhaust 28 is matched to a gap in the base housing 2 covering the base 1. Vectors 9 indicating the path of a mass of warm air as it travels through the warm air exhaust 28 to pass through the gap in the base housing 2, to be redirected onto the feet of a user of the footrest by the warm air shield 15 of FIG. 1. Exhaust fins 27 are provided in the warm air exhaust 28 to more evenly distribute the passage of the mass of warm air along the warm air exhaust 28 from the heating channel 22.

The exemplary embodiment of FIG. 2 shows the channel 22 fabricated from sheet metal bent, stamped and/or cut to form the desired channel shape. FIG. 2 also shows a series of screw holes 25 formed in the structure of the channel 22. These screw holes allow a cover (not shown in FIG. 2) to be placed over the channel 22, confining the passage of the mass of warm air between the heating element 23 and the warm air exhaust 28 to the channel 22. As shown in more detail in the following figure, the cover may be placed over the channel 22 and secured with sheet metal screws. Alternative methods of attachment may be available, as is know to those skilled in the art.

In an exemplary embodiment of the present footrest, the heating element 23 comprises a two-stage heater, similar to the type of heater found in home hair drying equipment. The heating element 23 may be more specifically comprised of bare, coiled nichrome wire wrapped around insulating mica boards. As is known to those skilled in the art, nichrome wire is an alloy of two metals, nickel and chromium. Nichrome wire is a desirable choice for a filament of the heating element 23 because of its conductive properties, and because unlike ferrous or other metals, it fails to oxidize when heated. As an alternative embodiment, heating element 23 may comprise a solid resistive heating element outfitted with a heat sink.

When the mass of cold air is initially propelled into the heating channel 22 by the radial fan 21, it is much cooler than the nichrome wire of the heating element 23. Due to this fact, heat flows from the nichrome wire to the mass of cold air. How hot the mass of cold air passing over the heating element 23 becomes is dependent in large part on the power supplied to the heating element 23. The higher the wattage, the more heat is generated in the heating element's coils and transferred to the mass of cold air.

The mass of cold air becomes heated immediately after passing over the heating element 23 and a mass of warm air is produced preferably moderately heated so that, while the mass of warm air is comfortable and soothing when directed at the feet of a user, it is not so hot as to be uncomfortable or dangerous.

When mass of cold air is drawn into the base 1 of the footrest by the radial fan 21, foreign particles may be pulled towards the cold air intake 3. To prevent particles above a certain size from entering the base 1, a wire screen is provided as part of the cold air intake 3. Without this screen, lint or other contaminants may build up inside the base 1 and be scorched by the heating element 23, or they may clog the radial fan 21 itself. An excess of these contaminants inside the base 1 can also partially block the airflow into the heating channel 22, potentially causing the heating element 23 to overheat due to the lessened airflow available to carry away the heat generated by the coils of nichrome wire.

In the footrest depicted in FIGS. 1 and 2, the base housing 2 may serve not only as a structural component of the footrest and to protect the component parts contained therein, but also to insulate the heating element 23 from transferring its heat directly to the base housing 2 and through it to the footplate 10. An arch in the base housing 2 further distances the footplate 10 and with it the user's feet from the heating element 23. In this manner the user's feet will be heated by the mass of warm air expelled from the warm air exhaust 28 (represented by vectors 9), rather than by a conductance of heat directly to the footrest 10 itself.

FIG. 2 shows a wiring harness 24 comprising a power cord and other necessary components for providing current to the radial fan 21 and the electric heater 23. Proper composition and arrangement of these components are known to those skilled in the art. A high/low heat switch 20 may be supplied as part of the wiring harness 24. This switch allows a user of the footrest to determine whether a greater or lesser amount of electrical power will be dissipated as heat by the heating element 23.

In an alternative embodiment, the high/low heat switch 20 may be provided mounted (in a manner not shown) on the footplate 10 shown in FIG. 1. The high/low heat switch 20 may additionally be mounted in a fashion allowing a user to select a desired heat setting using her foot.

In a further embodiment, the footrest may be provided with certain safety features to protect a user from burns or electrical shock. One feature comprises a safety cut-off switch included in the wiring harness 24. This safety cut-off switch (not shown) ensures that the mass of warm air expelled by the warm air exhaust 28 never exceeds a temperature above which it could possibly burn the skin of a user of the footrest. The safety cut-off switch may comprises a temperature sensitive device such as a bimetallic strip which would interrupt the flow of current to the heating element 23 when the temperature inside the heating channel 22 exceeded a certain limit.

The wiring harness 24 shown in FIG. 2 may also include a ground fault interrupt device (also not shown). As is known in the art, the ground fault interrupt device will trip and stop a flow of current through a pair of lines if it senses an imbalance between the current flowing in the hot and neutral lines. In this manner, were the wiring harness 24 to become improperly grounded and cause a potentially dangerous situation, the ground fault interrupt device would trip before significant harm could be caused.

Figure 3:
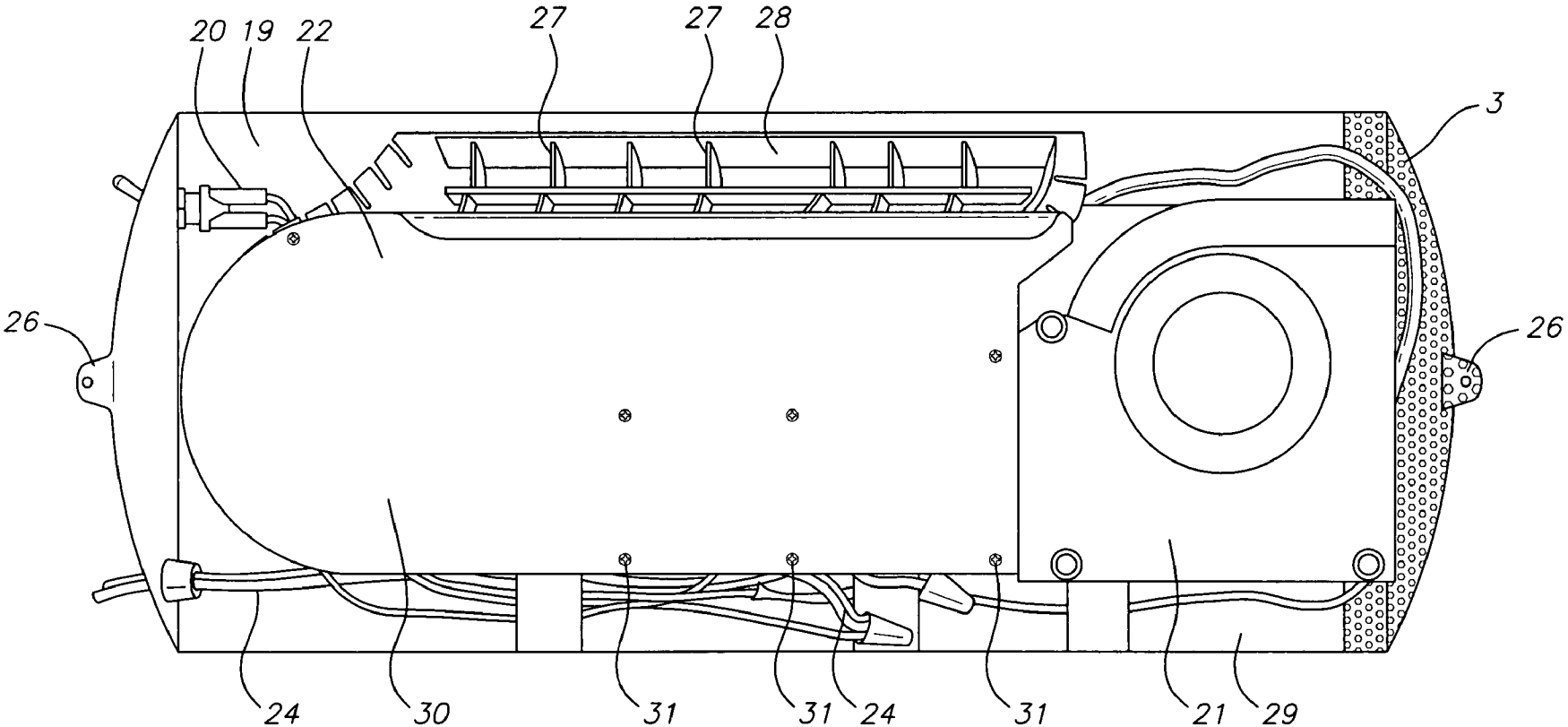
FIG. 3 is an overhead view of the base shown in the previous figure depicts the addition of a cover plate over the previously exposed heating channel.

FIG. 3 shows an overhead view of the base 1 of the footrest from FIG. 2, with the addition of a cover plate 30 over the previously exposed heating channel 22. A series of screws 31 are provided corresponding to the screw holes 25 of the previous figure. With the cover plate 30 attached to the heating channel 22 using the screws 31, an enclosed and relatively airtight passage is created between the radial fan 21 and the warm air exhaust 28. In this manner the radial fan can create a zone of high pressure at the beginning of the heating channel 22 forcing air across the heating element 23 and out the warm air exhaust 28.

Figure 4:
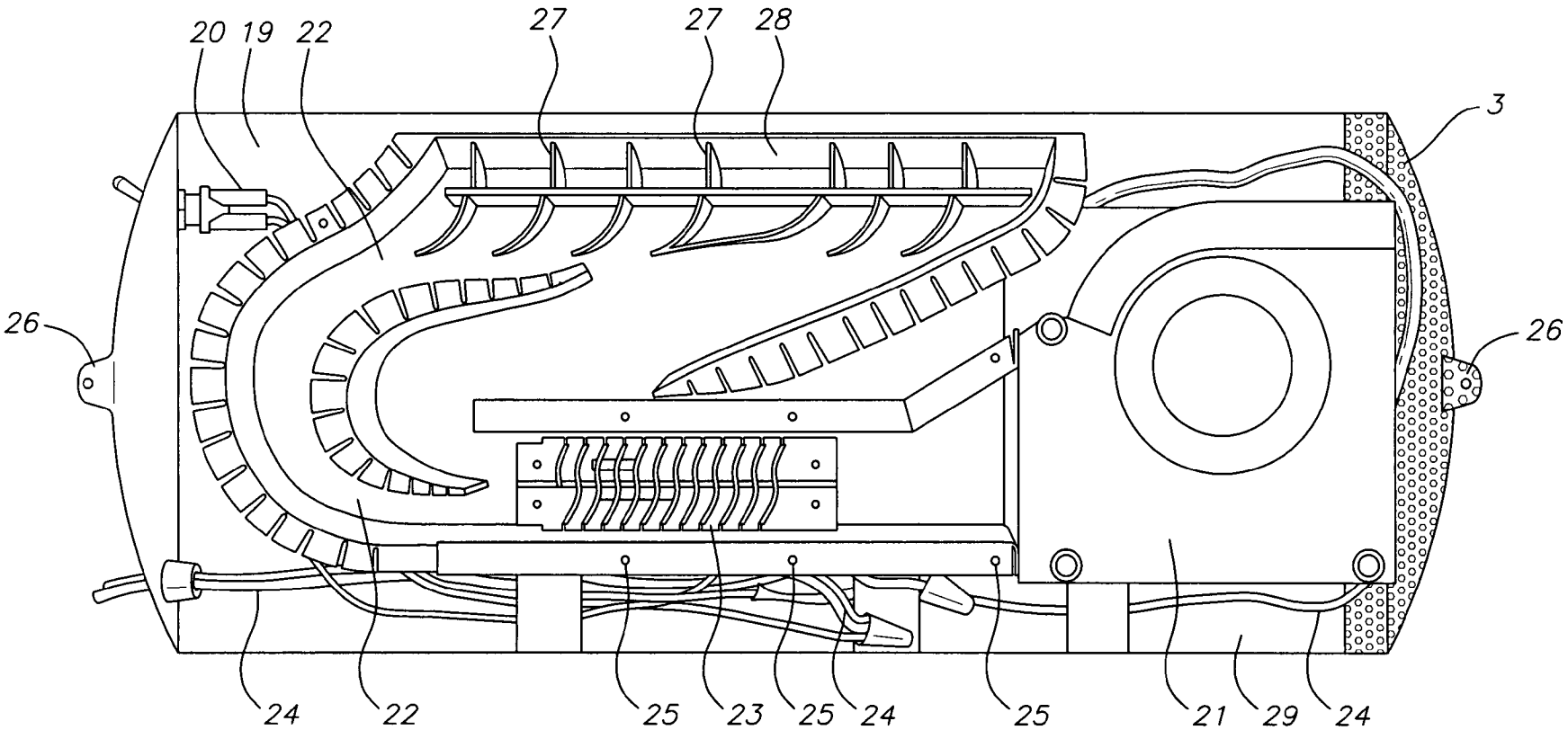
FIG. 4 shows multiple overhead views of the exposed interior of the base of the footrest of FIG. 2.

FIG. 4 depicts multiple overhead views of the exposed interior of the base 1 from FIG. 2. These views better depict the details of various components of the present footrest, including the cold air intake 3, high/low heat switch 20, radial fan 21, heating channel 22, heating element 23, wiring harness 24, mounting bracket 26, warm air exhaust 28 and the base plate 29.

Heretofore the invention has been discussed having a radial fan 21 for moving a mass of air through the footrest. A radial fan preferred given its quiet operation. However, alternatives exist to the radial-type are known in the art. In a series of alternative embodiments, a medium or high speed radial, axial, or drum type fan, a duct propeller fan, or a blower type fan driven by an electric fan motor may be provided in the present footrest.

The radial fan 21 preferably includes either an AC or a DC motor, which is directly coupled to the impeller of the radial fan 21. The motor may be electrically coupled to a conventional switch, included as part of the wiring harness 24, for turning the radial fan 21 on and off. This switch (not shown) may include multiple settings for various speeds which produce various air velocities for the mass of cold air propelled into the heating channel 22. In an embodiment of the present footrest, the heating element 23 is electrically coupled to the radial fan 21 by the wiring harness 24 so that a common switch (not shown) activates each of the radial fan 21 and the heater element 23. In another exemplary embodiment, the radial fan 21 and the heater element 23 may be separately controlled to disable the heating element 23 when the radial fan 21 is being operated so as to circulate a mass of cold air over the feet of a user of the footrest.

In further alternative embodiments of the present footrest, the user's foot may be heated by means other than heated air, such as by directing streams of steam to the user's foot or heating the footplate 10 itself. These heating means may be used in addition to or instead of the heating arrangements described above in reference to FIGS. 1–4.

In another alternative embodiment of the present footrest, a pair of footplates are provided 10, one to receive each foot of a user of the footrest.

It will be understood that various modifications can be made to the disclosed embodiments of the present invention without departing from the spirit and scope thereof. Therefore, the above description should not be construed as limiting the invention, but merely as an exemplification of preferred embodiments of the invention. Those skilled in the art will envision other modifications within the scope and spirit of the present invention.

What is claimed is:

1. A footrest comprising:

a base portion for placement on a supporting surface;

a footplate connected to the base portion for receiving a foot of a user of the footrest;

a heater connected to the base portion;

a warm air shield attached to the base portion;

an air intake system connected to the heater for drawing a first mass of air into the footrest; and an exhaust connected to the heater for expelling a second mass of air from the footrest;

wherein the heater receives the first mass of air through the air intake and expels the second mass of air through the exhaust; and wherein the warm air shield redirects the second mass of air expelled through the exhaust at the foot of the user.

2. The footrest of claim 1, wherein the heater warms the first mass of air to a defined temperature to produce the second mass of air.

3. The footrest of claim 2, wherein defined temperature is selected by the user.

4. The footrest of claim 2, wherein defined temperature is selected by the user through a control knob mounted on the footplate capable of being operated by the foot of the user.

5. The footrest of claim 1, wherein the warm air shield includes one or more recesses for receiving an instep of the foot of the user.

6. The footrest of claim 1, wherein the footplate is pivotable with respect to the base portion.

7. The footrest of claim 6, wherein the footplate may be pivoted to and held in a plurality of user selected pivot positions.

8. The footrest of claim 1, wherein the footplate includes one or more friction elements to grip the foot of the user.

9. The footrest of claim 1, wherein the footplate is capable of receiving a pair of feet of a user of the footrest.

10. The footrest of claim 1, further comprising a second footplate;

wherein the second footplate may be used in conjunction with the footplate to receive a pair of feet of a user of the footrest, with both the footplate and the second footplate each receiving one of the pair of feet.

11. The footrest of claim 10, wherein each of the footplate and the second footplate may be independently pivoted to and held in a plurality of user selected pivot positions.

12. The footrest of claim 1, wherein the base portion is vaulted and forms an extended arch.

13. The footrest of claim 1, wherein the heater includes a fan for drawing the first mass of air through the air intake, and expelling a second mass of air through the exhaust.

14. The footrest of claim 1, wherein the fan is a radial fan.

15. The footrest of claim 2, wherein heater includes a nichrome wire heating element for warming the first mass of air to a defined temperature to produce the second mass of air.

16. The footrest of claim 2, wherein heater includes safety device to disable the heater in the event that the first mass of air is heated substantially above the defined temperature.

17. A footrest comprising:

a base portion for placement on a supporting surface;

a footplate connected to the base portion for receiving a foot of a user of the footrest;

a heater connected to the base portion;

a warm air shield attached to the base portion;

an air intake system connected to the heater for drawing a first mass of air into the footrest; and an exhaust connected to the heater for expelling a second mass of air from the footrest;

wherein the heater receives the first mass of air through the air intake and expels the second mass of air through the exhaust;

wherein the second mass of air is expelled through the exhaust from a location in front of the foot in a substantially vertical direction directly onto the warm air shield; and wherein the warm air shield redirects the second mass of air expelled through the exhaust at the foot of the user.

18. The footrest of claim 17, wherein the warm air shield includes one or more recesses for receiving an instep of the foot of the user.

* * * * *